United States Patent [19]

Babler

[11] 3,960,075

[45] June 1, 1976

[54] ELASTOMERIC MOUNTING MECHANISMS

[75] Inventor: Egon S. Babler, Northbrook, Ill.

[73] Assignee: Teletype Corporation, Skokie, Ill.

[22] Filed: Mar. 24, 1975

[21] Appl. No.: 561,580

[52] U.S. Cl. ..... 101/93.48; 267/153; 74/470; 403/220

[51] Int. Cl.[2] ..... B41J 9/02

[58] Field of Search ..... 101/93.28–93.34, 101/93.48, 111; 403/225, 220, 291, 50, 226; 74/470; 267/57.1 R, 63 R, 153

[56] References Cited

UNITED STATES PATENTS

| | | | |
|---|---|---|---|
| 1,566,026 | 12/1925 | Leipert et al. | 403/220 X |
| 1,629,178 | 5/1927 | Shook | 403/220 X |
| 2,702,087 | 2/1955 | Beier | 403/225 X |
| 3,193,300 | 7/1965 | McDonald | 403/291 X |
| 3,207,539 | 9/1965 | Hackforth | 403/225 |
| 3,822,641 | 7/1974 | Babler | 101/93.33 |

FOREIGN PATENTS OR APPLICATIONS

| | | |
|---|---|---|
| 2,333,573 | 1/1974 | Germany |

*Primary Examiner*—J. Reed Fisher
*Assistant Examiner*—Edward M. Coven
*Attorney, Agent, or Firm*—J. L. Landis

[57] ABSTRACT

A workpiece, such as an interponent of a teleprinter is mounted for linear and pivoting movement in an elastomeric mounting element having a central section to which the workpiece is secured, a pair of end sections, and a pair of stretchable webs connecting the central section to the end sections. The end sections are mounted to a support so that the webs are stretched along a transverse mounting axis, and the workpiece is thereafter positioned by the mounting element in a stable initial position. From the initial position, the workpiece may be moved linearly or pivoted, or both, by external forces; and when so moved rotary and linear spring forces are generated in the elastomeric mounting element tending to return the workpiece toward the initial position when the external forces are removed.

11 Claims, 11 Drawing Figures

ELASTOMERIC MOUNTING MECHANISMS

INTRODUCTION AND BACKGROUND

This application relates generally to elastomeric mounting apparatus, and more particularly to apparatus for mounting a workpiece for linear and pivoting movement. In a specific example, the application concerns a system for mounting an interponent mechanism of an impact printer for compound linear and pivoting movements, and for exerting rotary and linear spring forces tending to return the interponent to a stable initial position.

In my prior U.S. Pat. No. 3,822,641, there is illustrated an impact printer in which an elongated, paddle-shaped interponent member is first elevated axially from an initial position in a first attitude by an electromagnet armature, then the upper tip of the interponent is struck by an impeller member to fire a print hammer and pivot the interponent to a second attitude, following which the interponent is lowered in the second attitude by a spring to the original level, and finally the interponent is pivoted back to the initial position and attitude. In the prior patent, a metal spring is illustrated for mounting the interponent and biasing it to the initial position.

OBJECTS AND SUMMARY

A specific object of the invention is to provide an elastomeric mounting and biasing member for such an interponent, to mount the interponent for compound linear and pivoting movements and for exerting rotary and linear spring forces tending to pivot and move the interponent axially back toward a highly stable neutral position, without the need for an up stop or a down stop for the interponent.

A more general object is to provide new and improved elastomeric elements for mounting workpieces for linear and pivoting movements, particularly a mounting element which offers essentially zero linear spring force at the start of linear movement of a workpiece, but which rapidly builds up a strong spring force after only limited movement of the workpiece, tending to return the workpiece to a stable neutral position. A further object is to provide such a mounting wherein hysteresis properties of the elastomeric material are used to control return movement of the workpiece and prevent a significant degree of overshooting on return to the initial position.

In accordance with certain features of the invention, such a mounting apparatus includes an elastomeric mounting element having a central section to which a workpiece is secured, a pair of end sections on either side of the central section, and a pair of stretchable webs connecting the central section and the end sections. The end sections are mounted to a support so that the webs are stretched along a transverse mounting axis, and the workpiece is thereby positioned by the mounting element in a stable initial position. The stretched webs define flexure joints on either side of the workpiece, permitting both pivoting and linear movement of the workpiece in response to the application of external forces to the workpiece. When the workpiece is pivoted or displaced linearly, rotary and linear spring forces are generated in the elastomeric mounting element tending to return the workpiece to the initial position when the external forces are removed.

Preferably, the mounting element is formed of an elastomer, such as polyurethane resin, having a spring rate characteristic such that the material initially offers essentially zero resistance to linear movement of the workpiece when first displaced from a rest position, but wherein the linear spring force rapidly builds up to a high value after only limited linear movement, such as 30–40 thousandths of an inch of displacement. Further, the elastomer preferably has hysteresis properties such that the spring return force is largely dissipated in the first few thousandths of an inch of return movement, and the workpiece returns to the rest position smoothly with very little tendency to overshoot.

In one embodiment, for mounting a paddle-shaped interponent of an impact printer of the type described above, the elastomeric material is molded about a mounting segment of the interponent, which is bonded within a central body section of the mounting element. The end sections are formed as a pair of mounting ears having holes formed therein, which are threaded on a pair of spaced rails to mount a row of the interponents on the pair of rails. The rails are then fastened in a machine frame, and spaced so as to stretch the webs a preset amount, the webs being formed as tapered connecting sections of reduced cross-sectional area between the ears and the central body section. With this arrangement, the rails position the interponents in predetermined locations in the printer, for compound axial and pivoting movements as described above and in the prior patent. When the interponent is moved in the printing process, the material in the stretched webs exerts rotary and linear spring forces to return the interponent toward a highly stable neutral position, without the need for providing either an up stop or a down stop to limit axial movement of the interponent.

Other objects, advantages and features of the invention will be apparent from the following detailed description of a specific example and embodiment thereof, when read in conjunction with the accompanying drawings.

DRAWINGS

In the drawings, FIG. 1 is a vertical cross section through a portion of an impact printer, taken generally along line 1—1 of FIG. 7 and corresponding generally to FIG. 2 of my prior U.S. Pat. No. 3,822,641. FIG. 1 illustrates an interponent mounting mechanism in accordance with one specific embodiment of this invention as used in an impact printer.

DETAILED DESCRIPTION

Background and General Arrangement of Printer

Figure 1:
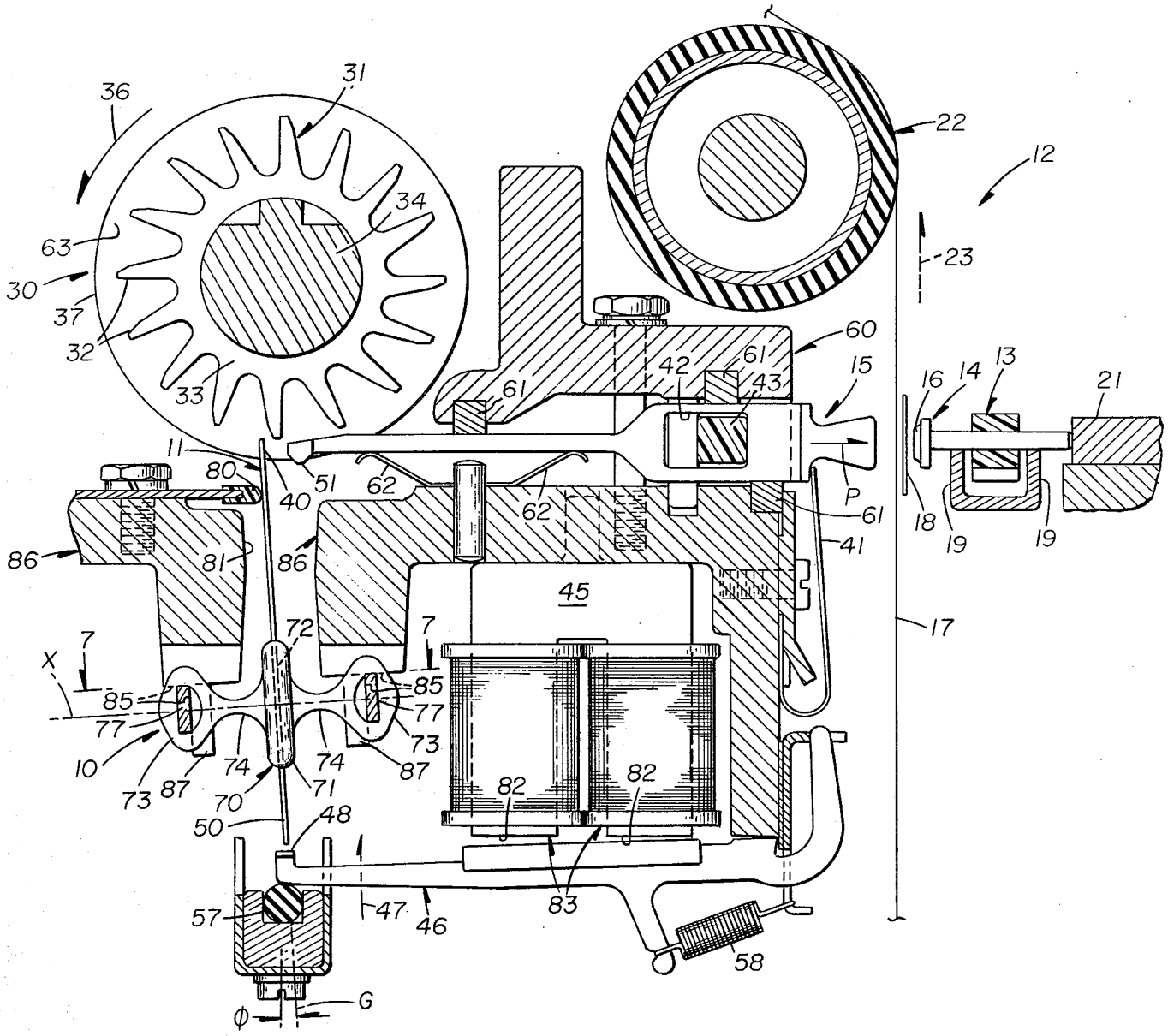

Referring now in detail to the drawings, and particularly to FIG. 1, this application concerns an improved mounting mechanism 10 for a workpiece such as interponent member 11 of an impact printer 12 of the type described in my prior U.S. Pat. Nos. 3,795,187; 3,805,695; 3,822,641; and 3,823,387, and in F. E. Huntoon-J. F. Kearney U.S. Pat. No. 3,742,848, all herein incorporated by reference.

Such a printer includes an endless carrier 13, such as a flexible belt, for advancing a plurality of type elements or pallets 14 (into the paper in FIG. 1) past a row of print hammers 15 in endless succession. The type pallets have type faces 16 formed along their inner ends, facing the hammers 15, the type faces comprising one or more fonts of alphanumeric characters to be printed. As the pallets 14 travel past the hammers 15, when a character is to be printed at any given column across a sheet of paper 17, the corresponding hammer 15 is fired; that is, driven rapidly to the right in FIG. 1, arrow P, so as to drive the adjacent portions of the paper 17 and an inked ribbon 18 together against the moving type pallet 14 to print each selected character or symbol. The type pallets 14 ride along positioning rails 19—19, which set the horizontal position of the line of type to be printed, and a backstop 21 is provided, against which the outer ends of the pallets 14 ride and which serves as a backstop for the printing operations.

Further details of the belt and pallet assembly 13–14 are described in the Huntoon-Kearney patent, and a preferred form of ribbon mechanism is described in A. F. Riley U.S. Pat. No. 3,825,103. The printer 12 also includes paper-advancing means, including a generally conventional feed roller 22 for advancing the paper 17 in the direction shown by arrow 23 after each line has been printed, as described in my U.S. Pat. No. 3,822,641.

Figure 9:
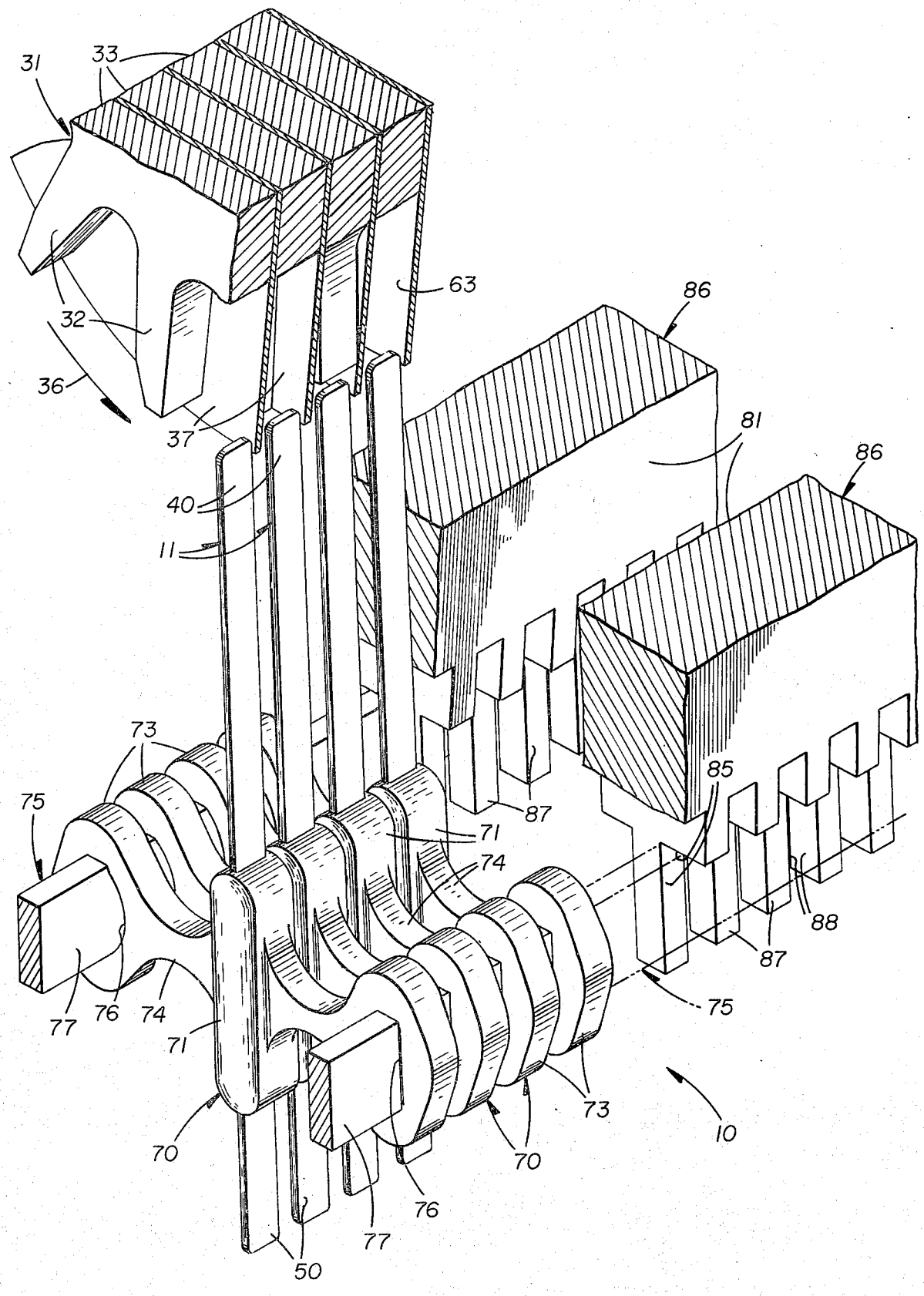
FIG. 9 is an exploded perspective view illustrating steps in the assembly of the interponents and mounting mechanisms in a printer.

A mechanism 30 for selectively firing the hammers 15 to print each selected character includes a toothed impeller wheel 31 associated and aligned with each hammer 15 and having a plurality of radial, equiangularly spaced impeller teeth 32 projecting outward from a central hub 33 as shown in FIGS. 1 and 9. The individual impeller wheels 31 are concentrically secured to an impeller shaft 34 for rotation therewith, and are continuously rotated in a counterclockwise direction as indicated by arrow 36. The individual impeller wheels 31 are axially spaced along the shaft 34 by a plurality of enlarged, very thin circular shims 37, such that each wheel 31 is disposed in alignment on an associated hammer 15 in a common vertical plane, such as the plane in FIG. 1. The position of each impeller wheel 31 and hammer 15 define one of the possible printing locations or columns across the width of the paper 17. Further details of the construction and arrangement of the impeller wheels are described in my U.S. Pat. No. 3,795,187.

Normally, in a rest or nonprinting position, the interponent 11 is positioned as illustrated in FIG. 1, with an upper or printing end 40 thereof located just below and out of the path of the oncoming impeller teeth 32. The hammer 15 is biased to a rest or leftward position by a spring 41, in which position the right-hand wall of a slot 42 formed through the hammer 15 rests against an elastomeric bumper 43, which serves as a stop for the hammer in the rest position.

Figure 2:
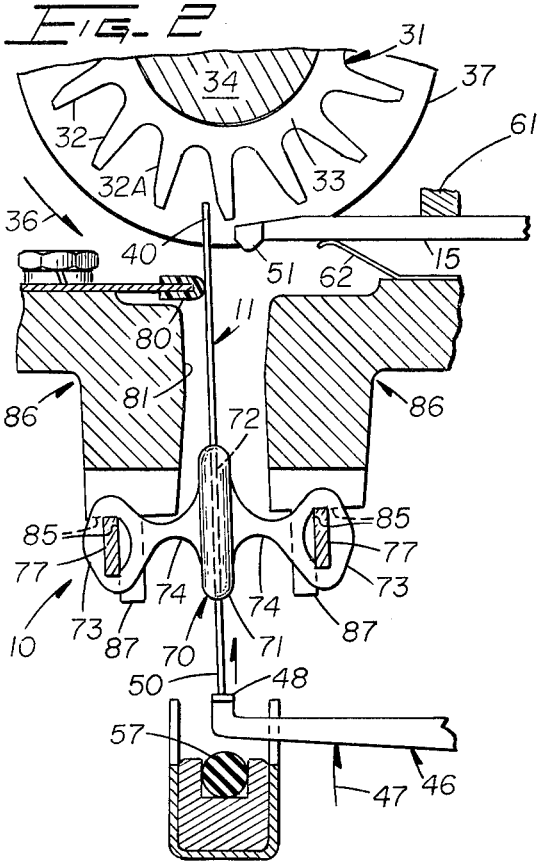
FIGS. 2–5 are sectional views similar to a portion of FIG. 1, illustrating sequential movements of the interponent and printing elements during a printing cycle.

When it is desired to print a character, an electromagnet 45 is energized, which pivots an armature 46 in a clockwise direction, arrow 47, from a rest position shown in FIG. 1 to an operated, essentially horizontal position shown in FIG. 2. As the armature pivots, an inner end or operating tip 48 moves upward into engagement with a lower end 50 of the interponent 11 and elevates the interponent a limited distance, such that the upper end 40 of the interponent is inserted into the space between two impeller teeth 32—32, as shown in FIG. 2. The next oncoming tooth 32A then engages the interponent tip 40 and drives it to the right (arrow 52) to the generally vertical position shown in FIG. 3, where the tip 40 engages and impacts an inner end 51 of the hammer 15, and thereby propels or "fires" the hammer rapidly to the right according to arrow P in FIGS. 1 and 4, to print the character as previously described.

Figure 3:
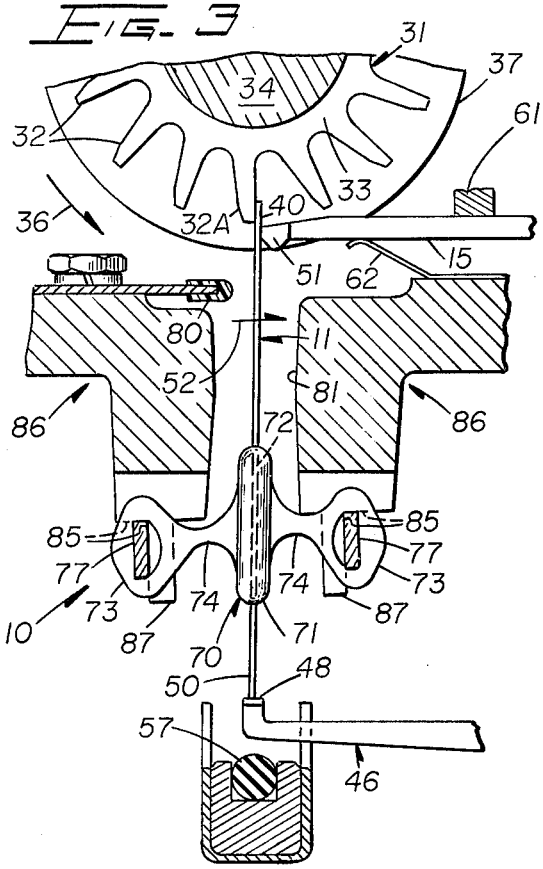
Figure 4:
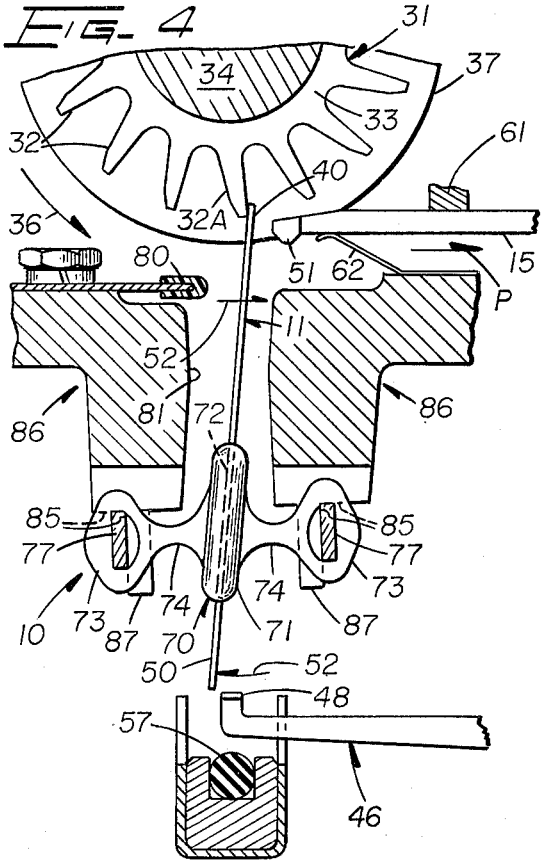

After the hammer has been fired, the operative tooth 32A continues to pivot the interponent 11 in a clockwise direction (arrows 52, FIG. 4) until the lower end 50 passes to the left of the actuating end 48 of the armature 46, as illustrated in FIG. 4 and is no longer supported by the armature tip 48. At this point, the interponent mounting means 10, forming the subject matter of this application, functions immediately to move the interponent 11 downward, arrow 53 in FIG. 5, out of the path of the impeller teeth 32, as will be described in detail in the following section. With this arrangement, the interponent 11 is lowered out of contact with the operating tooth 32A almost immediately after hammer impact. This effectively eliminates the chance of a second hit by the next impeller tooth 32B in the row, even through the electromagnet 45 is inherently slow to release the armature 46 for return to its rest position, from the operated position of FIGS. 2–5 to the rest position of FIG. 1, according to dotted arrow 54 in FIG. 5. These general features of interponent movement, and quick return apart from operation of the magnet 45 and armature 46, are described in detail in my prior U.S. Pat. No. 3,822,641.

When the electromagnet 45 releases, the armature 46 pivots back to the rest position of FIG. 1, by a spring 58 (FIG. 1), where the inner end 48 of the armature 46 rests on a resilient bumper or stop 57. When this occurs, the mounting mechanism 10 pivots the interponent 11 counterclockwise from the canted after-firing position of FIG. 5 back to the rest position of FIG. 1, with the lower end 50 poised just above the aramture tip 48 and in line therewith, in preparation for the next printing command at a subsequent line along the paper 17.

Further details of construction and arrangement of the armatures 46 and electromagnets 45 are described in my U.S. Pat. No. 3,805,695, in my copending application, Ser. No. 441,191, filed Feb. 11, 1974, and in J. F. Kearney U.S. Pat. No. 3,785,283. An exemplary control system and circuits for operating the magnets 45 to fire the hammers in proper timed relationship are described in D. A. Brodrueck U.S. Pat. No. 3,845,710.

The hammers 15 are mounted in a printer frame designated generally by the numeral 60, for precise horizontal movement along the printing line of arrow P. This mounting includes spaced wear guides 61—61 mounted in the frame above and below the hammer 15 and along which the hammer 15 rides, and a leaf spring 62 mounted in the frame below the hammer 15 to urge it upward against the wear guides 61 for precise linear movement.

As the hammer 15 is impelled to the right to print, the left wall of the hammer slot 42 strikes the left wall of the bumper 43, which is mounted in the frame 60, to dampen printing force and to return the hammer 15 rapidly to the initial position shown in FIG. 1 (arrow -P in FIG. 5), with a minimum of rebound. Further details of construction and arrangement of the hammers 15 and bumper 43 are described in my U.S. Pat. No. 3,823,667.

In addition to guides for the hammers 15 and interponents 11 as generally described in my prior patents, the enlarged circular shims 37 formed along the impeller shaft 34 are precisely spaced intervals between the impeller wheels 31 also provide spaces 63 therebetween for locating and guiding the inner ends 51 of the hammers 15 and the upper tips 40 of the interponents 11 for movement in a precise vertical plane with respect to the impeller wheels 31, which plane is set by the shims 37. This arrangement is illustrated fragmentarily in the perspective view at the top of FIG. 9 wherein, on assembly of the printer, the tip 40 of the interponent 11 at the center fits into and is located and guided by the slot 63 therebetween two adjacent shims 37—37. The hammer tips 51 are similarly located and guided in the slots 63, as indicated in FIG. 1.

This Applicaton

Referring now to FIGS. 6–9, this application specifically relates to an improved mechanism 10 for mounting a workpiece for linear and pivoting movement, and particularly for mounting a workpiece such as an interponent 11 described above for successive or compound linear and pivoting movements of the types illustrated in FIGS. 1–5.

In accordance with one specific embodiment of this invention, the mounting mechanism 10 includes an elastomeric support member or mounting element 70 having a central section 71 to which a portion 72 of the interponent 11 is secured, a pair of end sections 73—73 on either side of the central section 71, and a pair of stretchable connecting sections or webs 74—74 between the central section 71 and the end sections 73—73.

Figure 5:
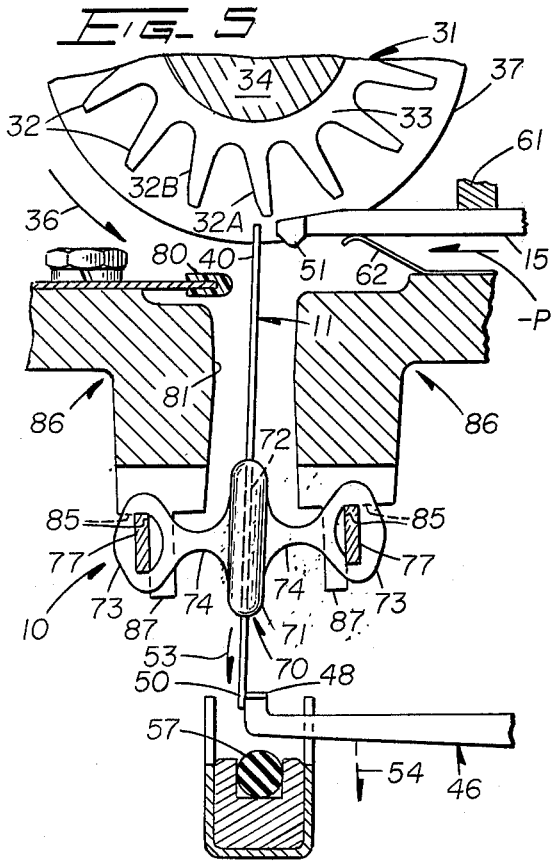
Figure 7:
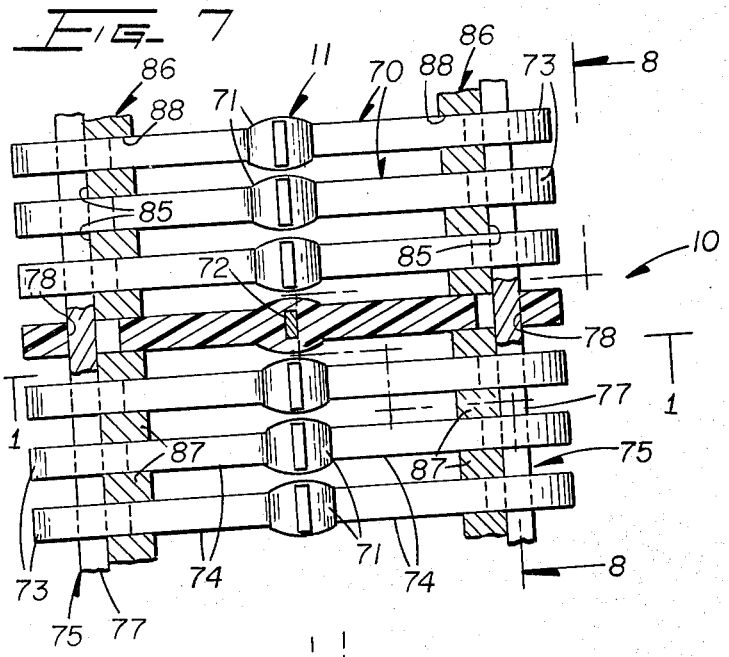
FIG. 7 is a top view of a row of interponents and mounting mechanisms, taken generally along line 7—7 of FIGS. 1 or 6, and partly in horizontal section along axis X of FIG. 6.
Figure 8:
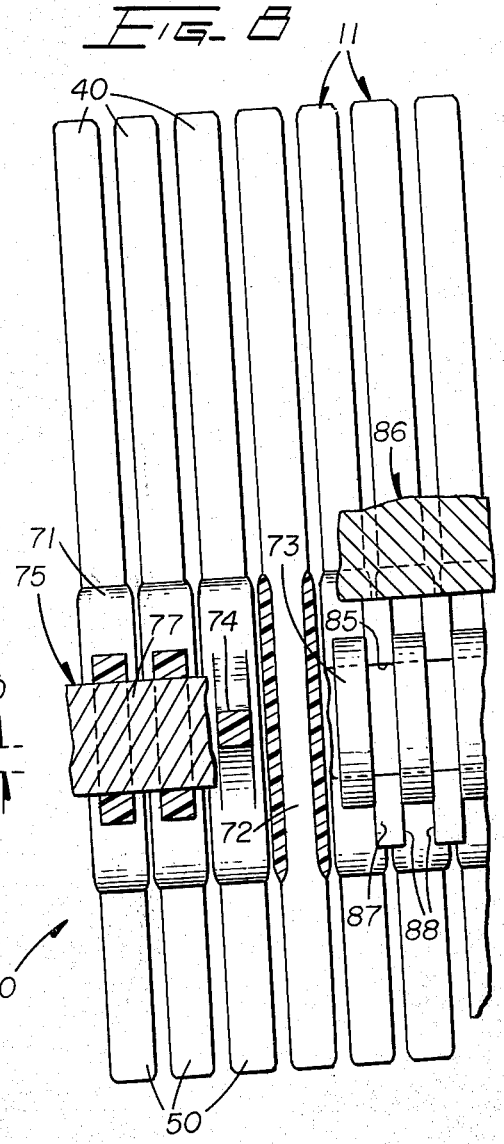
FIG. 8 is a side view of the assembly of FIG. 7, partly in section along line 8—8 of FIG. 7.
Figure 6:
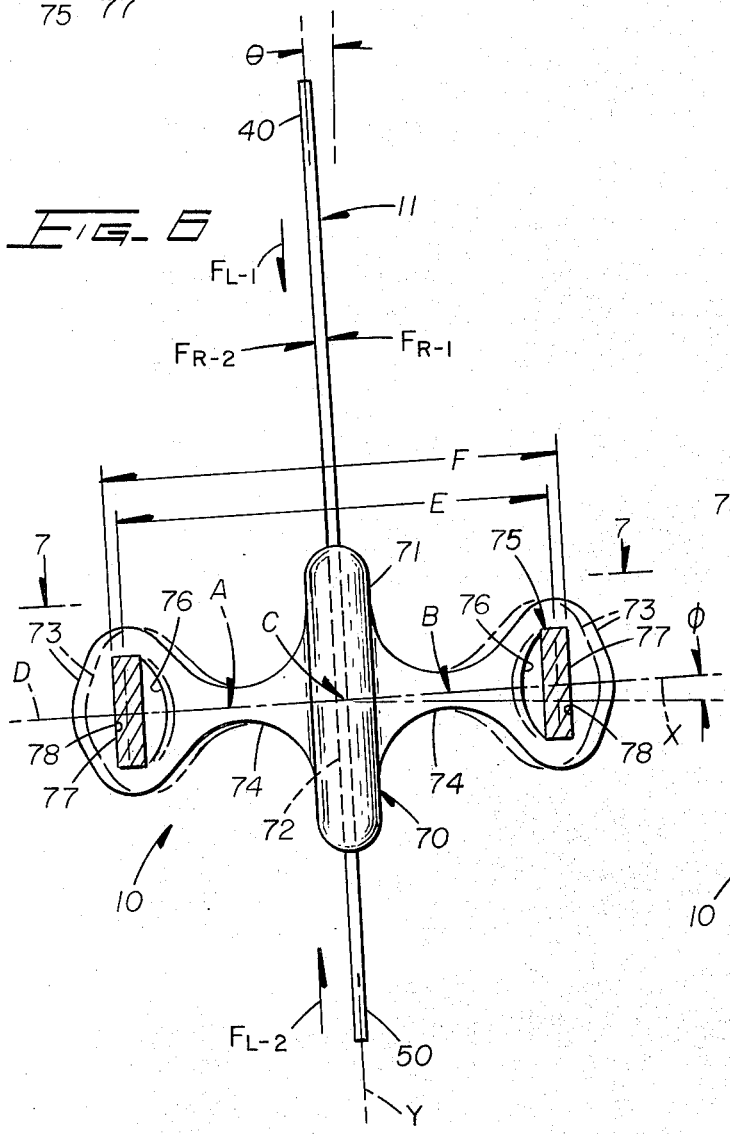
FIG. 6 is an enlarged detail view of the interponent and mounting mechanism in the same plane as FIG. 1.

To assemble the mounting element 70 and workpiece, the end sections 73—73 of the mounting element are mounted on a support, designated generally by the numerals 75—75, so that the webs 74—74 are stretched along a transverse mounting axis X (FIG. 6) and the workpiece is thereby positioned by the element 70 in a stable initial position shown in FIG. 6. In the example illustrated, in the initial position, the longitudinal axis of the interponent 11 is positioned along a rest or neutral axis Y perpendicular to the mounting axis X and centered between the end sections 73—73, with a mounting center C of the interponent lying along the transverse mounting axis X. The stretched webs 74—74 define flexure joints A and B on either side of the interponent 11, which permit pivoting movement of the interponent about the mounting center C and also linear movement of the interponent along the neutral axis Y in FIG. 6, or along any other axis (FIGS. 1–5) in which the interponent is tilted from time to time. When the interponent 11 is pivoted or moved linearly in response to external forces, spring forces are generated in the elastomeric mounting element 70 tending to return the workpiece to the stable initial position of FIG. 6 when the external forces are removed.

In the specific embodiment illustrated, for mounting an interponent 11 of a teleprinter 12 for the particular compound pivoting and linear movements illustrated in FIGS. 1–5, the mounting member 70 is preferably formed as a one-piece molding of an elastomeric material, such as a polyurethane resin having properties described hereafter. In this example, the interponent 11 consists of a thin rectangular steel bar or paddle having the configuration shown in FIGS. 6–8 (at approximately four times actual size), and it is desired to position the interponent 11 with its mounting center C about one-third of the distance up from the bottom end 50. To secure the interponent 11 in the central section 71 of the mounting element, the mounting portion or segment 72 of the interponent 11 is formed with a reduced width, as shown in cross section in FIGS. 7–8, in the area covered by the central section 71 of the element 70. The mounting element 70 is preferably injection molded about the mounting segment 72 of the interponent 11, to secure the segment 72 in the central section 71 of the element 70 and to bond the polyurethane material to the interponent body.

The central section 71 of the mounting element 70 is preferably elongated along the axis of the interponent 11 to firmly secure the interponent in the central section 71 so that the central section follows all movements of the interponent, as shown in FIGS. 1–5, and in effect becomes part of the interponent. The reduced width segment 72 of the interponent serves to reduce the outer width of the mounting element-interponent assembly 70-11, from left to right as viewed in FIG. 8, so as to permit mounting of the interponents 11 in a closely spaced row as viewed in FIGS. 7–8 as is required in an impact printer 12 of the type under consideration herein.

While a specific technique is described above, for securing an elongated paddle-shaped workpiece such as an interponent 11 to the central section 71 of the mounting element 70, it should be understood that various other mounting or fastening techniques could be used, the main principle being to secure a mounting portion 72 of the workpiece to the central section 71 of the elastomeric mounting element 70 so that the central section follows movements of the workpiece, linear or pivoting, in response to the application of external forces to the workpiece.

In the specific embodiment illustrated, the end sections 73—73 of the mounting element 70 are formed as enlarged, roughly circular ears, having generally semicircular mounting holes 76—76 arranged as illustrated in FIG. 6. The holes 76—76 serve to mount the end sections 73—73 on a pair of spaced rectangular mounting rails 77—77 forming part of the support 75 previously mentioned, for mounting the end sections 73—73 in the preset positions described above to set the initial position of the mounting elements 70 and the interponents 11 carried thereby. Ultimately, the rails 77 are fastened to a portion of the printer frame 60, as will be described hereafter, to mount the elements 70 and interponents 11 carried thereby in their prescribed positions in the printer 12, as shown in FIGS. 1–5.

In the example illustrated, the mounting holes 76 are formed with flat outer surfaces 78—78 that, on assembly of the unit as shown in solid lines in FIG. 6, are received securely against flat outer surfaces of the rails 77. On assembly of the rails 77 in the printer 12, the rails are spaced a distance F between outer surfaces set so that the connecting webs 74—74 of the element 70 are stretched a preset amount along the transverse axis X, as viewed in FIG. 6. The mounting axis X is set by the positions of the two rails 77—77 in this embodiment, and extends through the centers of the rails, along the centers of the webs 74—74, and through the central section 71 of the element 70 to define the mounting center C for the interponent 11.

An initial unstretched configuration of the mounting element 70, prior to mounting on the rails 77—77 and assembly of the rails in the printer frame 60, is illustrated in phantom lines in FIG. 6, whereas the stretched or mounted position is shown in solid lines. Prior to mounting, the outer flat surfaces 78—78 of the mounting holes 76—76 are spaced by a distance E (unstretched length), whereas on mounting between the rails 77—77, this distance is increased to the distance F (stretched length) as previously described, to stretch the webs 74—74 a preset amount on each side.

In the specific example illustrated, the web sections 74 comprise generally U-shaped tapered sections smoothly interconnecting the end section 73 on either side with the central body section 71 and having a reduced width area at the center defining the plane of the flexure joints A and B on each side approximately midway between the rails 77—77 and the mounting center C. In a typical example, as viewed in FIG. 8 (third interponent from the left), this reduced area comprises a generally square section having sides of approximately 0.065 inches. However, this parameter of minimum web cross section must be set empirically, based on the particular elastomer used, so that the webs will stretch the amount needed in the system to establish the desired spring forces, as described hereafter, but not sufficiently that the element 70 will snap at the flexure joints after repeated flexing and stressing in the operation of the system. In the example above, the stretched length F is approximately 0.04 inches greater than the unstretched length E, which amounts to a stretching in the webs of approximately 0.02 inches on each side in the typical example.

When stretched to the solid line position of FIG. 6 along the transverse mounting axis X, the elastomeric material of the webs 74 exerts rotary biasing or spring forces, designated by the arrows $F_{R\text{-}1}$, $F_{R\text{-}2}$ in FIG. 6, tending to center the interponent 11 precisely along the neutral axis Y perpendicular to the mounting axis X. For example, if the interponent 11 is pivoted about the center C in a clockwise direction, as in a printing operation (arrows 52 in FIGS. 3–4), the counterclockwise rotary spring force $F_{R\text{-}1}$ operates to return the interponent promptly toward the neutral position when the external forces (impeller tooth 32A, FIG. 4, and armature tip 48, FIG. 5) are removed from the system. Similarly, the clockwise rotary spring force $F_{R\text{-}2}$ operates to return the interponent toward the neutral position when pivoted in a counterclockwise direction.

The stretched webs 74 further exert linear biasing or spring forces, designated $F_{L\text{-}1}$, $F_{L\text{-}2}$ in FIG. 6, tending to center the interponent 11 precisely along the transverse axis X, with the mounting center C falling on the axis X. For example, if the interponent 11 is moved upward along the neutral axis Y in FIG. 6 (or along any other axis in which the interponent may be pivoted at any time) as in a printing operation (arrow 47 in FIGS. 1–2), the downward linear spring force $F_{L\text{-}1}$ operates to move the interponent promptly downward to the neutral position when the external lifting force (armature 46) is removed from the system, as viewed in FIGS. 4–5. Conversely, if the interponent 11 is pushed downwardly in FIG. 6, the upward linear spring force $F_{L\text{-}2}$ functions to elevate the interponent to the neutral centered position.

Further, the interponent 11 may be sequentially or simultaneously pivoted and moved axially, as in FIGS. 1–5, in which case the combination of rotary and linear spring forces, such as $F_{R\text{-}1}$ and $F_{L\text{-}1}$ in the FIG. 5 position, is set up to both pivot and move the interponent axially back toward the neutral position and attitude of FIG. 6 when the external forces are removed. While not used in the printer system of this application, the interponent 11 can also be pivoted limited distances about axes other than the center C, such as about the lower tip 50 in the position of FIG. 5, or it can be moved linearly in directions other than axial, such as by shifting along axis X in FIG. 5 limited distances toward or away from one of the rails 77.

In essence, the interponent 11 is freely suspended between the rails 77—77 in a highly stable neutral position and attitude shown in FIG. 6 in the absence of external forces applied thereto, but it may be pivoted or shifted linearly through limited distances in various directions, which generates spring forces in the elastomeric material of the webs 74 tending to return the interponent to the neutral position.

In the embodiment illustrated, for mounting an interponent 11 of an impact printer 12 of the type described above, the mounting rails 77—77 are slightly offset vertically when assembled in the printer, with the rail 77 on the right side being elevated slightly above the rail on the left, so that the element 70 is positioned along a transverse mounting axis X inclined by an angle $\theta$ from the horizontal, about 3° from the horizontal in a typical example. When mounted in the printer, as viewed in FIG. 1, an interponent stop 80 is provided for engaging the left side of the interponent 11 a short distance below the upper tip 40. The stop 80 is fixed in a portion of the printer frame 60, and is so positioned at the left side of an interponent passage or channel 81 that the interponent 11 comes to rest position along an initial axis G inclined by an angle $\phi$ to the vertical. In this example, the stop 80 extends sufficiently far to the right in FIG. 1 that the initial mounting angle $\phi$ is smaller than the neutral angle $\theta$ in FIG. 6, being approximately 2½° in a typical example where $\theta$ is 3°. With this arrangement, the stretched web sections 74—74 exert a light rotary biasing force $F_{R\text{-}1}$ (FIG. 6) urging the interponent 11 counterclockwise against the stop 80 as viewed in FIG. 1. This sets the initial or rest position of the interponent 11 and mounting element 70 in the printer 12, as illustrated in FIG. 1, with the interponent positioned in a rest attitude along an initial axis G and biased slightly into the rest position by the material of the stretched mounting element 70.

In this initial attitude, the interponent 11 is suspended in the channel 81 solely by the elastomeric material of the mounting element 70, except for the contact with the stop 80 near the top of the interponent. No down stop is needed, and the initial stable vertical position is set solely by the mounting element 70 as previously described. As illustrated in FIG. 1, the lower end 50 of the interponent 11 in the initial position is spaced above the upper end of the armature tip 48 and in alignment therewith, with a preset clearance or gap 48–50 therebetween.

When the armature 46 is actuated, arrow 47 in FIGS. 1 and 2, it first travels the gap 48–50 in FIG. 1 and then engages the bottom surface of the interponent 11 and exerts a vertically upward force to lift the interponent 11 upward a predetermined distance from the rest position of FIG. 1 to the fully extended position of FIG. 2, where the interponent tip 40 is inserted into the path of the impeller teeth 32. In a typical example, the gap 48–50 is approximately 0.01 inches, and the length of interponent travel is approximately 0.035 inches, to provide an overlap of about 0.025 inches between the upper tip 40 of the interponent 11 and the operative impeller tooth 32A, this overlap being shown in exaggerated fashion in FIGS. 2–4 for purposes of illustration. Thus, the armature tip 48 travels a total distance of approximately 0.045 inches. The limits of travel of the armature 46 are set by the down stop or bumper 57 in the open position of FIG. 1 and by a pair of flat under surfaces 82—82 of a pair of electromagnet cores 83—83 in the closed or energized position of FIG. 2, which surfaces 82 attract and hold the armature 46 in the actuated or up position until the armature is released as described in my U.S. Pat. No. 3,805,695.

With the mounting arrangement described above, the mounting element 70 continues to bias the interponent 11 counterclockwise against the stop 80 ($F_{R\text{-}1}$) as the interponent is lifted from the FIG. 1 position to the FIG. 2 position, thus maintaining the initial attitude of the interponent 11, along axis G cocked at the preset angle $\phi$ to the vertical. As the interponent 11 is moved linearly upward along the initial axis G, the material of the ribs 74—74 is distorted and exerts an increasingly strong linear spring force ($F_{L\text{-}1}$) tending to return the interponent to the lower position of FIGS. 5 and 1.

In the extended position, FIGS. 2, 3, 4, the mounting element 70 permits the required pivoting movement of the interponent 11 about the center C (FIG. 6) from the initial cocked attitude of FIG. 2, through the generally vertical firing position of FIG. 3, to the reverse cocked or fired position of FIG. 4. As previously mentioned, the flexure joints A and B (FIG. 6) of the web sections 74—74 readily permit this pivoting movement, and exert the relatively low rotary spring force $F_{R\text{-}1}$ tending to pivot the interponent counterclockwise back toward the initial position illustrated in FIG. 1.

After firing, when the lower end 50 of the interponent 11 passes to the left of the armature tip 48, as illustrated in FIG. 4, the relatively powerful linear spring force $F_{L\text{-}1}$ stored in the element 70 is released, and very rapidly returns the interponent to its lower position as shown in FIG. 5, arrow 53. At this point, the relatively light rotary spring force $F_{R\text{-}1}$ also pivots the lower end 50 of the interponent 11 against the left side of the armature tip 48, as illustrated in FIG. 5. The interponent 11 remains in this lower, reverse canted position as shown in FIG. 5 until the armature 46 is released and drops back to the rest position of FIG. 1. As the armature 46 returns from the FIG. 5 position to the rest position of FIG. 1, against the down stop 57, the left side of the armature tip 48 passes below the lower end 50 of the interponent 11, which thereafter pivots counterclockwise back to the initial position of FIG. 1 under the influence of the stored rotary force $F_{R\text{-}1}$ and the initial position of FIG. 1 is promptly reestablished by the mounting element 70, with the gap 48–50 reset between the interponent 11 and the armature 46.

Referring now to FIGS. 1 and 7–9, the steps in assembling a row of the mounting elements 70 and interponents 11 on the mounting rails 77—77, and then mounting the rails in portions the printer frame 60 are illustrated. As previously mentioned, individual subassemblies of the interponents 11 and mounting elements 70 are preferably formed in an injection molding operation, in which the central section 71 of each mounting element 70 is securely bonded to the mounting segment 72 of the corresponding interponent 11 to form a unitary assembly of individual interponents and mounting elements as illustrated in FIGS. 6–9.

In the assembly, a row of mounting elements 70 in the unstretched condition (phantom lines in FIG. 6), with interponents 11 attached, is first assembled on the two unmounted rails 77—77 as shown at the left in FIG. 9. In the unstretched condition of the elements 70, the mounting holes 76 in the end sections 73 of the elements 70 are sufficiently large that the mounting elements can easily be threaded on the rails 77 to position the elements 70 loosely in a spaced row as illustrated in FIG. 9. After this subassembly of rails 77—77 and the required number of mounting elements 70 and interponents 11 has been formed, the rails 77 are then placed against mounting shoulders 85—85 (best shown in FIG. 9) formed in a pair of spaced mounting blocks 86—86 (see also FIG. 1), which form part of the printer frame 60 and which define the interponent channel 81 therebetween. When the rails 77—77 are positioned against the shoulders 85—85 and then fastened to the spaced blocks 86, this stretches the web 74 of each mounting element 70 and sets the initial position of each element 70, along the transverse mounting axis X in the printer 12, as previously described in connection with FIG. 6. The relative elevation of the lower flat shoulder 85 on each side sets the assembled positions of the rails 77—77 on each side, as previously described, and thus sets the angle $\theta$ of the transverse axis X and thus the stable neutral position of the interponents 11 as shown in FIG. 6. The amount of stretching of the webs 74—74 along the transverse axis X, as previously described, is preset at the desired length (F minus E in FIG. 6) by the spacing between the two blocks 86—86, from right to left as viewed in FIG. 1, which automatically sets the assembled positions of the two rails 77—77 at the desired distance F in FIG. 7.

The mounting blocks 86 are also formed with spaced, downwardly extending, T-shaped projections 87—87 which define the mounting shoulders 85—85, and which provide horizontal spaces 88 therebetween for receiving and precisely locating the end sections or ears 73 of each mounting element 70. This sets the horizontal position (from left-to-right in FIGS. 8–9) of each interponent 11 in the row, and precisely aligns each interponent with the associated impeller wheel 31 above it and armature 46 below, as previously described. This assembly of elements 70, 77, etc. in the printer 12 is also shown from the top in FIG. 7 and from the right side in FIG. 8.

Considering now in more detail the desired properties and parameters of the elastomeric material used in fabricating the mounting element 70, there are various factors of geometry and physical properties of the elastomer to consider for different types of workpieces to be mounted and different types and amounts of linear and/or pivoting movement required. Obviously, in the printer 12 embodiment illustrated, the size and spacing of the interponents 11 to be mounted and the limits of interponent pivoting and linear movement in the directions previously described are dictated by the requirements and geometry of the printer, and the mounting element 70 must be tailored to fit this particular geometry and required movements.

In this embodiment, it is particularly desirable to provide an elastomeric material with linear spring properties ($F_L$) set so that, initially, when the armature tip 48 first engages the lower end 50 of the interponent 11 and begins to lift the interponent (arrow 47 in FIG. 1), the material offers a very low, essentially zero resistance to upward movement along the initial axis G ($F_L$=0 in the rest position of FIG. 1). However, very quickly, after only limited upward movement of the interponent, the downward linear spring force $F_{L-1}$ builds up to a high value urging the interponent 11 back downward toward the rest position, as described above. In the printer example given above, the total linear displacement of the interponent 11 is only 0.035 inches, thus this rapid build-up in spring force is very important.

Figure 10:
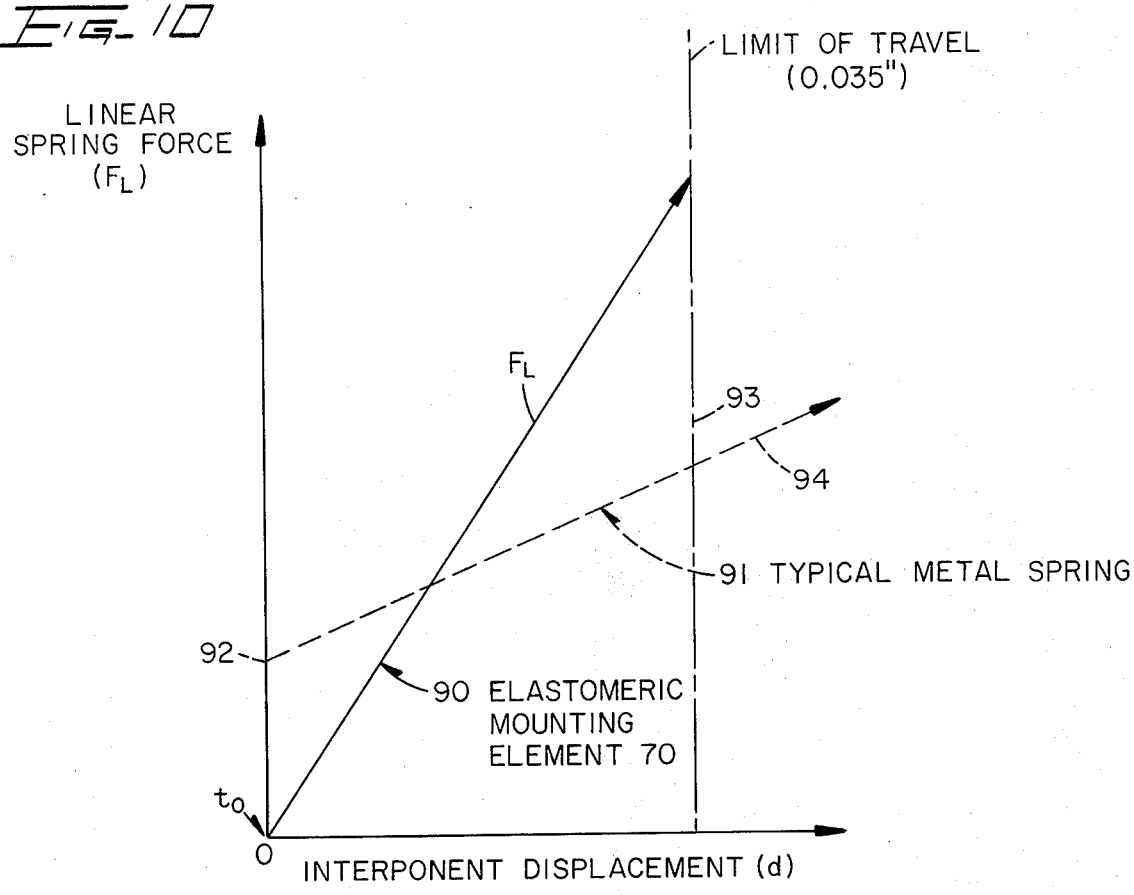
FIG. 10 is a force vs. displacement graph, comparing spring force characteristics of a mounting element according to one embodiment of this invention with a standard spring biasing member.
Figure 11:
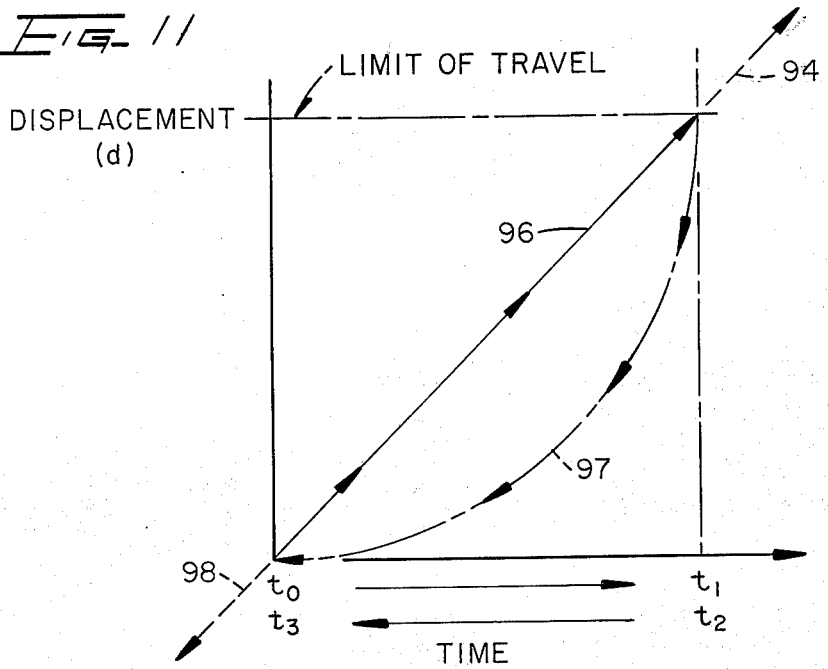
FIG. 11 is a displacement vs. time graph illustrating linear movement of the interponent during a typical cycle of operation and hysteresis properties of the mounting element.

FIG. 10 illustrates (curve 90 in solid lines) a typical "spring rate" characteristic curve for the elastomeric mounting element 70 having the configuration shown in FIG. 6, depicting the linear spring force $F_L$ generated in the material as a function of displacement (*d*) of the interponent 11 upward (or downward) along the interponent axis in this type of mounting. For comparison, curve 91 in dotted lines depicts the spring rate characteristic of a typical steel coil spring or tension spring. As is evident from the curve 90, the elastomeric mounting 70 starts with essentially zero spring force ($F_L = 0$) in the rest position, at a time $t_0$ prior to engagement of the interponent 11 by the armature 46, and then increases according to a relatively steep slope 90 shown up to the upper limit of displacement (*d*), such as 0.035″ in the example given, when the armature 46 bottoms out against the magnet cores 83. In contrast, a typical steel spring starts out at an initial bias force 92 required to set the initial position of the workpiece, and then increases along a more shallow slope 91 to a lower maximum force 93 at the upper limit of travel.

With this arrangement, there is no tendancy with the elastomeric mounting element 70 for the interponent 11 to overshoot in the up direction, and thus no need to provide an up stop for the interponent 11 as previously described. In contrast, with a typical metal spring, the interponent tends to overshoot, as indicated by line 94, in the up direction since the force applied by the armature 46 is exponential and is increasing very rapidly at the end of the stroke, as the armature 46 hits the magnet cores 83 and suddenly stops. Also, when the armature 46 first engages the interponent 11, the lifting force is weakest and the provision of a zero spring force in the elastomer 70 at the contact point (time $t_0$) is very helpful in reducing the electromagnet power requirements in the system.

Another important characteristic of the elastomeric mounting 70 is the displacement vs. time characteristics shown in FIG. 10, illustrating the hysteresis properties of elastomeric materials such as the polyurethane resin used. Curve 96 illustrates the movement of the interponent 11 as it is lifted by the armature 46 through the distance (*d*) prior to the printing operation, exhibiting a nearly linear displacement vs. time curve from times $t_0$ to $t_1$ on elevation. However, on return, times $t_2$ to $t_3$, the natural hysteresis of the elastomer causes travel along a curve 97, such that the initial portion of travel resultant from release of the strong stored spring force $F_L$ is very fast, after which the remaining travel slopes gradually on return to the initial position. Thus, there is very little tendency for the interponent to overshoot either on the upstroke (line 94) as previously described, or on the downstroke (dotted line 98). In contrast, a standard steel spring follows a generally straight line curve, such as 96, in both directions thus having a pronounced tendency to overshoot in the return direction and practically requiring the use of a down stop, with attendant wear and bounce problems as is well known in the art.

Thus, the combination of resilient and hysteresis properties of elastomers, such as the polyurethanes, make them very useful in the practice of this invention, and provide for automatic centering of the interponent in the highly stable neutral position of FIG. 6 or in the tilted position of FIG. 1. Polyurethanes are also rugged and durable, impervious to machine oils used in the printer, can easily be injection molded into shapes such as shown in FIG. 6, and bond well to steel workpieces such as the interponent 11.

As is well known, there are various polyurethanes available on the market, having a range of properties that can readily be tailored to requirements such as are used in this application of the mounting element 70. In particular the resilience, dampening, spring rate, etc. can be tailored to match the magnet system and interponent travel required in the printer. Among ranges of properties useful in particular applications, selected parameters that have been found to work well in the printer 12 of this application are a resilience of approximately 20% on the Bashore rebound scale, and a Durometer hardness of D70, which is a function of spring rate (spring force vs. displacement curve as in FIG. 9) in this type of material.

One suitable polyurethane material used in the practice of the invention in the configuration of FIG. 6 is available from du Pont Corporation, a Delaware corporation, and designated "L-42".

While one specific example and embodiment of the invention have been described in detail herein, it should be obvious that various modifications may be made from the specific details described, without departing from the spirit and scope of this invention.

What is claimed is:

1. In combination with a machine of the type having an elongated mechanical interponent mounted in a machine support frame for both axial and pivoting movements, an improved mounting and actuating mechanism for said interponent comprising:

a. a mounting element of elastomeric material having (1) a central section in which a mounting segment of the interponent is fixed so that the central section of the mounting element is constrained to follow movement of the mounting segment of the interponent, (2) a pair of end sections, and (3) a pair of stretchable webs of reduced cross section connecting the end sections to the central section;

b. means for securing the end sections of the mounting element in the machine support frame in positions spaced a distance such that the webs are longitudinally stretched predetermined amounts along a transverse mounting axis extending through the end sections, along the webs, and through the central section of the mounting element, so that the elastomeric material of the stretched webs mounts the interponent in a stable initial position and defines flexure joints on both sides of the interponent permitting both axial and pivoting movements of the interponent about the flexure joints and so that the material of the stretched webs exerts both linear and rotary spring forces tending to return the interponent to the initial position in the absence of external forces acting on the interponent; and c. mechanical means for periodically engaging the interponent in the initial position and moving it axially and pivoting it about the flexure joints to an operated position and attitude and thereafter releasing the interponent, after which said spring forces return the interponent both axially and rotationally to the stable initial position.

2. Apparatus as recited in claim 1, wherein the securing means includes a pair of rails, each end section of the mounting element having a mounting hole slideably received on an associated rail, and means for fastening said rails in the machine support frame in spaced parallel relationship to each other to set the initial position of the interponent.

3. Apparatus as recited in claim 2, wherein the rails are rectangular in cross section and the mounting holes are semicircular holes of sufficient size that the end sections of the mounting elements can be threaded on the rails, with the flat surfaces of the mounting holes engaging flat outer surfaces of the rails.

4. Apparatus as recited in claim 3, wherein the fastening means includes a pair of spaced mounting blocks forming part of the machine frame, the blocks having rectangular mounting shoulders against which the rails are positioned to located the rails in preset positions with respect to the machine, thus setting the initial position of the interponent centered between the mounting blocks, the spaced blocks defining an interponent channel therebetween within which an operating end of the interponent is suspended for axial and pivoting movements as recited in claim 1.

5. Apparatus as recited in claim 4, for mounting a row of interponents in a predetermined spaced parallel relationship in a machine, wherein:

a row of the mounting elements are mounted at spaced intervals along the lengths of the rails; and the mounting blocks are formed with means for receiving and locating the end sections of the mounting elements so as to precisely position a plurality of the interponents in a spaced, parallel row along the length of the rails and mounting blocks.

6. Apparatus as recited in claim 1, wherein the webs comprise generally U-shaped tapered sections smoothly interconnecting the end section on either side with the central section and having a reduced width area at the center of the web section on each side defining flexure joints on each side of the interponent.

7. Apparatus as recited in claim 6, wherein the mounting element comprises a one-piece molding consisting of a polyurethane resin, the central section of the mounting element being molded about the mounting segment of the interponent to securely bond the central section of the mounting element to the adjacent segment of the interponent so that the central section of the mounting element is constrained to follow axial and pivoting movements of the mounting segment of the interponent.

8. Apparatus as recited in claim 1, wherein the means for periodically engaging the interponent and moving it axially includes an electromagnet, and an electromagnet armature having a tip positioned for engaging one end of said interponent and moving the interponent axially a predetermined limited distance from the initial position to an extended position when the electromagnet is energized, the linear spring rate characteristics of the elastomeric material being such that the material offers essentially zero resistance to axial movement as the armature tip first engages the interponent to move it to the extended position, but such that an increasingly strong linear spring return force builds up in the material as the interponent moves to the second position.

9. Apparatus as recited in claim 8, wherein the linear displacement vs. time characteristics of the elastomer exhibit substantial hysterisis properties on return travel to the initial position, such that the initial portion of return travel resultant from release of the stored linear spring force is very fast relative to the remaining portion of return travel.

10. Apparatus as recited in claim 9, wherein the machine includes no axial stop members for the interponent other than the mounting element.

11. In combination with a teleprinter of the type having an elongated mechanical interponent mounted generally vertically in a channel of a printer support frame for axial and pivoting movements, electromagnetic means for moving the interponent axially upward from an initial position in an initial attitude to an extended position, means for striking the interponent in the extended position and pivoting it to a second attitude, and means for mounting the interponent in the channel for combined linear and pivoting movements and for biasing the interponent toward the initial position and attitude in the absence of external forces applied by the electromagnet means and the striking means, an improved mechanism for mounting and biasing said interponent, which comprises:

a. a mounting element of elastomeric material having a central section in which a central portion of the interponent is fixed, a pair of end sections formed on on either side of the body section, and a pair of stretchable webs of reduced cross section connecting the end sections to the central section and providing a flexure joint on either side of the body portion:

b. a pair of spaced parallel rails on which the end sections are mounted; and c. means for mounting the rails generally horizontally in the printer support frame below the channel and in spaced, parallel relationship to each other, the rails being spaced a distance so that the webs are stretched along a transverse mounting axis extending through the end sections, along the webs, and through the central section of the mounting elements, the material of the stretched webs exerting both rotary and linear spring forces to center the interponent in the channel in a stable initial position, and to return the interponent to the initial position following operation of the electromagnetic means and the striking means.

* * * * *